United States Patent [19]

Oka

[11] Patent Number: 4,652,850

[45] Date of Patent: Mar. 24, 1987

[54] POTENTIOMETER

[75] Inventor: Tsumoru Oka, Miyagi, Japan

[73] Assignee: Alps Electric Co., Ltd., Japan

[21] Appl. No.: 820,575

[22] Filed: Jan. 16, 1986

Related U.S. Application Data

[63] Continuation of Ser. No. 587,170, Mar. 7, 1984, abandoned.

[30] Foreign Application Priority Data

Mar. 8, 1983 [JP] Japan ..... 58-32240[U]

[51] Int. Cl.[4] ..... H01C 10/30

[52] U.S. Cl. ..... 338/160; 338/118; 338/162; 338/166; 338/190

[58] Field of Search ..... 338/162, 166, 184, 190, 338/202, 163, 164, 199, 118

[56] References Cited

U.S. PATENT DOCUMENTS

| | | | |
|---|---|---|---|
| 3,424,897 | 1/1969 | Marchesini et al. | 338/184 X |
| 4,085,399 | 4/1978 | Wall | 338/199 X |
| 4,139,831 | 2/1979 | Ortlieb et al. | 338/162 X |
| 4,318,075 | 3/1982 | Pudelko et al. | 338/162 |
| 4,344,063 | 8/1982 | Nishimoto et al. | 338/162 X |

FOREIGN PATENT DOCUMENTS

| | | | |
|---|---|---|---|
| 1358988 | 6/1963 | France | 338/162 |
| 2250460 | 7/1975 | France | 338/162 |

*Primary Examiner*—E. A. Goldberg
*Assistant Examiner*—M. M. Lateef
*Attorney, Agent, or Firm*—Guy W. Shoup

[57] ABSTRACT

A potentiometer which can be used for measurement of angles includes an enclosure made of insulating material. The enclosure has a positioning portion comprising a pair of grooves to guide a resistance base plate into the enclosure. The enclosure is provided with a recess extending perpendicular to the plane of the base plate to rotatably receive the shaft portion of a sliding member. This sliding member further includes a slider which is brought into sliding contact with electrodes formed on the base plate. This produces a change in the resistance of a resistance member formed on the base plate.

5 Claims, 11 Drawing Figures

POTENTIOMETER

FIELD OF THE INVENTION

This is a continuation application from application Ser. No. 587,170 filed Mar. 7, 1984, now abandoned.

The present invention relates to a potentiometer which can be used for measurement of angles, and so forth.

SUMMARY OF THE INVENTION

It is the object of the present invention to provide a potentiometer which is made up of a small number of components, easy to assemble, and economical from an overall point of view.

This object is accomplished in accordance with the teachings of the present invention by providing a potentiometer which comprises an enclosure made of insulating material, a positioning portion in the enclosure for receiving and positioning a resistance base plate, a recess formed in the enclosure near the positioning portion for receiving the shaft portion of a sliding member, the recess extending perpendicular to the contact surface of the base plate, and a slider formed on the sliding member and brought into contact with the contact surface of the base plate.

BRIEF DESCRIPTION OF THE DRAWINGS

FIG. 4 (*b*) is a front elevation of the base plate shown in FIG. 4 (*a*);

DETAILED DESCRIPTION OF THE INVENTION

Figure 1:
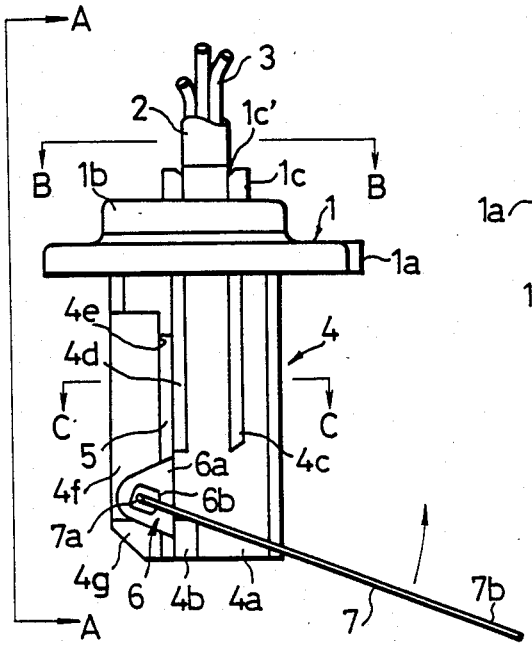
FIG. 1 is a top view of a potentiometer according to the present invention.
Figure 2:
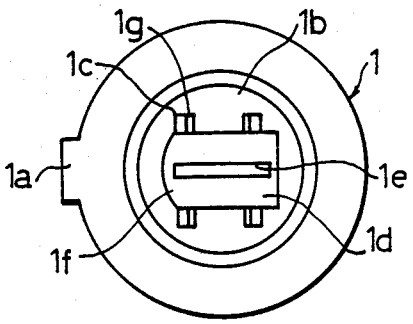
FIG. 2 is a cross-sectional view taken on the line B—B of FIG. 1.

Referring first to FIGS. 1 and 2, a embodying the concept of the present invention has a disklike cover 1 and an enclosure 4 below the cover 1. The cover 1 and the enclosure 4 are integrally produced from insulating synthetic resin by molding. A bulge 1*b* is formed on the top of the cover 1 and is provided with a recess 1*d* having a bottom 1*f*, in which a rectangular hole 1*e* is formed to receive a resistance base plate 5 (described later). Two pairs of projections 1*c* are formed on the bulge 1*b* so as to surround the recess 1*d*, each pair of the projections being disposed in opposed relation to each other. The top surface of each projection 1*c* has a tapered portion 1*g*. The projections 1*c* and the tapered portions 1*g* act to facilitate anchoring of a harness 2 which ensheathes lead wires 3 connected to the resistance base plate (described later) 5. According to the purposes for which the present rheostat is used, it is possible to bend and insert the lead wires 3 between those of the projections 1*c* which lie in a desired direction to ensure that the wires 3 extend in the desired direction.

Figure 3:
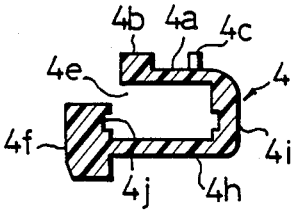
FIG. 3 is a cross-sectional view taken on the line C—C of FIG. 1.
Figure 5:
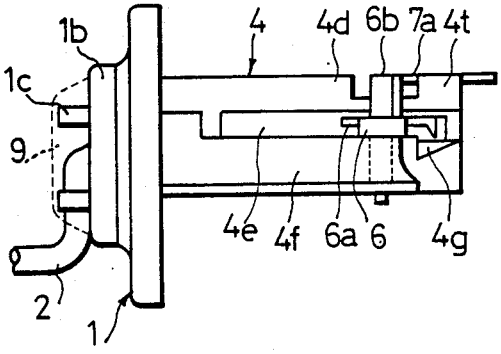
FIG. 5 is a side elevation of the potentiometer of FIG. 1 as viewed in the direction indicated by arrows A.

The substantially boxlike enclosure 4 integral with the cover 1 has a flat upper surface 4*a*, which is provided with projections 4*b* and 4*c* substantially at the center and the left lower end thereof, respectively. The ends 4*l* and 4*m* of the protrusions 4*b* and 4*c*, respectively, are inclined in reverse directions. A projection 4*d* extending parallel to the projection 4*c* is a reinforcing rib. As shown in FIG. 3, the enclosure 4 is centrally provided with a cavity 4*e* which is in communication with the aforementioned rectangular hole 1*e* in the cover 1. The lowermost portion of the enclosure 4 opens to the outside through the cavity 4*e*. A side portion 4*f* is disposed on the opposite and lower side of the cavity 4*e* from the upper surface 4*a* of the enclosure 4. The side portion 4*f* has an end portion provided with a portion 4*g* which sinks and tapers off outwardly as shown in FIG. 5. The enclosure further has a bottom portion 4*h* and another side portion 4*i*. The opposed inner walls of the side portions 4*f* and 4*i* are each provided with a groove 4*j* to guide the resistance base plate 5 (described later) into the enclosure 4 and to determines the position at which the plate 5 is inserted.

The aforementioned resistance base plate 5 is fabricated from ceramic and has a plate portion 5*a* that has a contact surface 5*g* at its upper surface. A resistance member 5*d* and a pair of electrodes 5*e*, on which a slider (described later) making a sliding movement, are formed on the contact surface 5*g* by a known process. The lead wires 3 which are connected to the resistance member 5*d* and to the electrodes 5*e*, 5*f* by means of soldering as indicated by numeral 8 are attached to a terminal 5*b*. the base plate 5 is formed with a notch 5*c* which distinguishes the terminal 5*b* from the plate portion 5*a* that is different in dimension from the terminal 5*b*. In particular, the width of the terminal 5*b* is made larger than that of the plate portion 5*a*, and the width of the rectangular hole 1*e* in the cover 1, in which the plate 5 is inserted, is so large as to allow insertion of the plate portion 5*a* of the base plate 5 but small enough to inhibit insertion of the terminal 5*b*.

A sliding member 6 is rotatably mounted in the cavity 4*e* in the enclosure 4 in the manner as described later. The member 6 has a slider support 6*a* and a driver portion 6*b*. A lever 7 made of an aluminum rod has a curved end portion 7*a* which comes into contact with the driver portion 6*b* of the sliding member 6. The other end portion 7*b* is coupled to an object (not shown) whose angular displacement is to be measured.

Figure 4A:
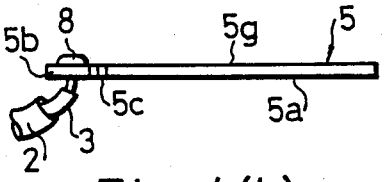
FIG. 4 (*a*) is a side elevation of the resistance base plate of the potentiometer shown in FIG. 1.
Figure 4B:
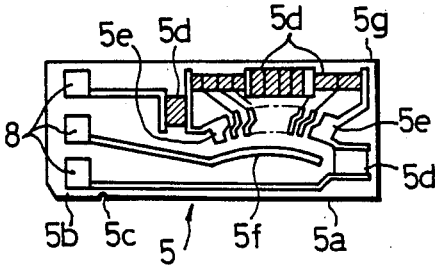
Figure 6:
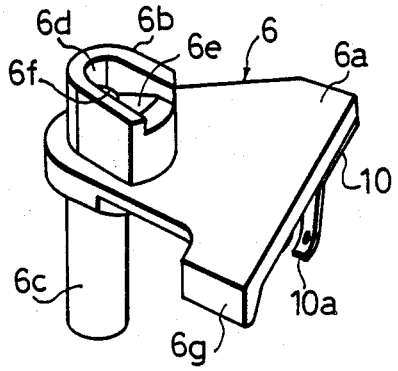
FIG. 6 is a perspective view of the sliding member of the potentiometer shown in FIG. 1.
Figure 7A:
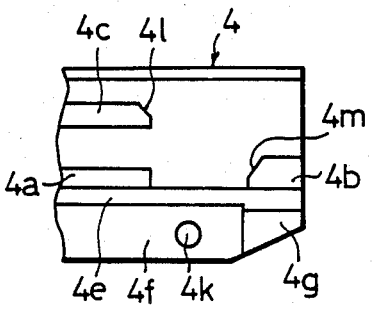
FIGS. 7 (*a*)–7 (*d*) are views for illustrating the manner in which the potentiometer of FIG. 1 is assembled.
Figure 7C:
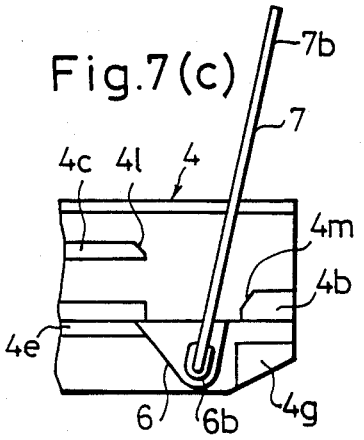
Figure 7B:
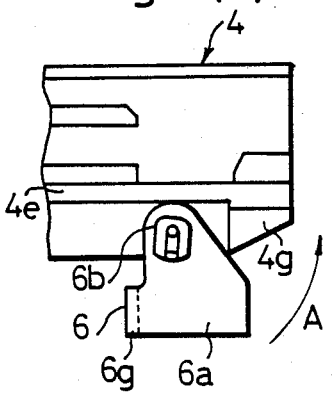
Figure 7D:
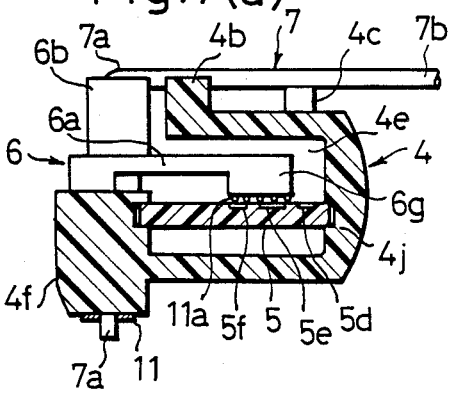

The manner in which the foregoing components are assembled and their operation are hereinafter described. First, the resistance base plate 5 to which the harness is attached as shown in FIG. 4 is inserted into the cavity 4*e* in the enclosure 4 through the rectangular hole 1*e* formed in the bottom portion 1*f* of the cover 1 as shown in FIG. 2 and through the guide groove 4*j*. Then, as shown in FIG. 5, the harness 2 is fitly inserted between one pair of the protrusions 1*c* and is brought ut. Thereafter, the recess 1*d* in the cover 1 is sealed off together with the harness 2 with adhesive 9, and the base plate 5 is mounted to the enclosure 4. As shown in FIG. 6, the sliding member 6 comprises the slider support 6*a* shaped like a sector, the driver portion 6*b* protruding upwards from the support 6*a*, and a hollow shaft portion 6*c*, all of which are formed integrally from lead by die casting. A slider 10 has a contact element 10*a* which is curved so that it may readily ride over the tapering portion 4*g*, and the slider 10 is firmly secured to the support 6*a* by crimping or similar means. The driver portion 6*b* has an opening 6*d*, a hole 6*f*, and a tapering portion 6*e* which sinks toward the hole 6*f*. As shown in FIG. 7 (*a*), the side portion 4*f* of the enclosure 4 is provided with a recess 4*k* that extends perpendicular to the plane of the base plate 5. The sliding member 6 is mounted to the enclosure 4 such that the shaft portion 6*c* is rotatably inserted in the recess 4*k*. Subsequently, the support 6*a* is pressed into the cavity 4*e* in the enclosure 4 while rotating the sliding member 6 in the direction indicated by the arrow A as shown in FIG. 7 (*b*). Thus, the protrusion 6*g* and the curved contact element 10*a* of the sliding member 6 ride over the tapering portion 4*g* formed at the end of the side portion 4*f* of the enclosure, and then they are received in the cavity 4*e* in the enclosure 4 without introducing any problems. As a result, as shown in FIG. 7 (*c*), the contact element 10*a* of the slider 10 mounted to the underside of the sliding member 6 comes into resilient contact with the electrodes 5*e* and 5*f* on the base plate 5. Then, the bent end portion 7*a* of the lever 7 is inserted into the hole 6*f* in the driver portion 6*b* of the sliding member 6 while guided by the tapering portion 6*e*. An anchoring ring 11 is then anchored to the front end of the bent end portion 7*a* so that the lever 7 may interlock with the sliding member 6, thus completing the assemblying operation.

The potentiometer constructed as described above is operated as follows. The device is coupled to an object whose angular displacement, for example, is to be measured. Rotation of this object turns the lever 7 together with the sliding member 6 about the shaft portion 6*c* in the cavity 4*e* in the enclosure. This causes the slider 11 to slide on the electrodes 5*e* and 5*f* on the base plate 5, resulting in a change in the resistance value of the resistance member 5*d*. This change can be detected by an electrical means to measure the angular displacement of the object. In this case, the lever 7 extending over the sliding member 6 rotates between the inclines 4*l* and 4*m* of the ends of the projections 4*c* and 4*b*, respectively. Thus, the angle through which the sliding member 6 can rotate is limited.

As thus far described, the novel potentiometer according to the invention is made up of a small number of components, easy to assemble, and hence economical from an overall point of view.

While the described embodiment represents the preferred form of the present invention, it is to be understood that various modifications and changes will occur to those skilled in the art without departing from the spirit of the invention. The scope of the invention is therefore to be determined solely by the appended claims.

What is claimed is:

1. A potentiometer comprising a substantially box-shaped enclosure having a longitudinal axis and being made of insulating material, the enclosure having:

a cover plate integrated with one end of the enclosure and oriented perependicular to said longitudinal axis, said cover plate having a slot formed therein for insertion of a resistance base plate in said enclosure;

a rectangular resistance base plate having a resistance contact surface on one side thereof inserted in said enclosure, said cover plate having means surrounding the slot for anchoring a harness containing wires which are electrically connected to the resistance base plate inserted in the enclosure;

a positioning portion for receiving and positioning the resistance base plate within the enclosure parallel to the longitudinal axis of the enclosure, a recess formed near the positioning portion to one side of the resistance base plate, said recess having an axis extending perpendicular to the contact surface of the resistance base plate, and a slider member having an arc-sector portion positioned in the enclosure for pivotal movement and provided with a slider mounted on said arc-sector portion that slides on the contact surface of the resistance base plate, said slider member having a shaft portion at one end thereof which is pivotally mounted in said recess, said slider member including a lever coupler having a coupler axis coaxial with said shaft portion and located at said one side of the resistance base plate for engaging a lever to cause the pivotal movement of the slider member.

2. A potentiometer as set forth in claim 1, including a lever that engages said lever coupler of said slider member to rotate the slider member, said lever extending from inside to outside said enclosure.

3. A potentiometer as set forth in claim 2, wherein said enclosure is provided with a pair of protrusions to limit rotation of the lever.

4. A potentiometer as set forth in claim 2, wherein said slider member comprises a plate having said shaft portion on one side thereof and said lever coupler on the other side thereof.

5. A potentiometer as set forth in claim 4, wherein said shaft portion and slider are on one side of said plate and said lever coupler is on the other side of said plate positioned opposite from said shaft portion.

* * * * *